United States Patent [19]

Casey

[11] Patent Number: 4,788,927

[45] Date of Patent: Dec. 6, 1988

[54] RETRACTABLE TOWING SHACKLE

[75] Inventor: James M. Casey, Houston, Tex.

[73] Assignee: Shell Western E&P, Inc., Houston, Tex.

[21] Appl. No.: 150,470

[22] Filed: Jan. 29, 1988

Related U.S. Application Data

[63] Continuation of Ser. No. 901,351, Aug. 28, 1986, abandoned.

[51] Int. Cl.[4] ..... B63B 21/20

[52] U.S. Cl. ..... 114/249; 114/242; 114/218; 59/86

[58] Field of Search ..... 114/218, 293, 242, 249, 114/252, 253, 264, 230; 440/33; 59/86, 88, 93; 405/203; 280/292, 480, 495, 417, 498, 478, 478 B, 500, 504, 502, 505, 491 B, 491 F, 493; 410/109, 111, 112, 113

[56] References Cited

U.S. PATENT DOCUMENTS

| | | | |
|---|---|---|---|
| 3,042,944 | 7/1962 | Basey et al. | 114/253 |
| 3,412,693 | 11/1968 | Lewis | 410/111 |
| 3,526,394 | 9/1968 | Howell, Jr. | 263/33 |
| 4,297,962 | 11/1981 | Johnson, Jr. | 114/218 |
| 4,455,109 | 6/1984 | Lorenz | 405/203 |

FOREIGN PATENT DOCUMENTS

| | | | |
|---|---|---|---|
| 1217287 | 5/1966 | Fed. Rep. of Germany | 114/218 |

*Primary Examiner*—Joseph F. Peters, Jr.
*Assistant Examiner*—Edwin L. Swinehart

[57] ABSTRACT

A method and apparatus for towing an offshore structure which is protected from damage caused by ice impinging on the walls of the structure when the apparatus is not in use by positioning a retractable towing shackle within a recess in an outer wall of the structure.

7 Claims, 2 Drawing Sheets

RETRACTABLE TOWING SHACKLE

This is a continuation of application Ser. No. 901,351 filed Aug. 28, 1986 now abandoned.

FIELD OF THE INVENTION

This invention relates to an apparatus for use in an offshore exploration and/or production structure.

BACKGROUND OF THE INVENTION

Offshore exploration and production has recently been extended into the ice-infested waters of the Arctic in such locations as northern Alaska and Canada. These waters are generally covered with vast sheets of ice at least 9 months of the year. These ice sheets are generally stationary near the shore and actually move laterally with wind and water currents further offshore. These ice sheets can impose very high forces on any stationary structure in their paths.

Due to these environmental conditions, conventional towing devices carried by the structure may be damaged by the ice sheets impinging on the outer walls of the structure.

Applicant is not aware of any prior art which, in his judgment as one skilled in this paticular art, would anticipate or render obvious the present invention. However, for the purpose of fully developing the background of the invention, and establishing the state of the requisite art, the following art is set forth: U. S. Pat. Nos. 1,378,102; 1,179,765; 3,042,944; and 3,494,124.

SUMMARY OF THE INVENTION

It is the purpose of the present invention to provide a method and an apparatus for towing an offshore structure which is protected from damage caused by ice impinging on the walls of the structure when the towing device is not in use.

In a preferred embodiment, the present invention comprises a retractable shackle assembly located in a recess formed in the structure's outer walls. The shackle assembly would be located such that it is above the water line when the structure is floating at its lightship draft for towing. When positioned at the drilling location the structure will be ballasted down to the sea floor. The shackle assembly at this point may be above or below the water line depending upon the water depth. The shackle assembly, having spaced legs terminating in eyes is operatively engageable with a mounting device secured within the wall via a pin passing therethrough. The mounting device may be located in the wall at the upper or lower portions of the recess so as to allow the shackle assembly to be lowered or raised, respectively, to a resting position within the recess.

The shackle can be substantially U-shaped or partially circular-shaped.

A retaining device, such as dogs, operatively carried by the outer walls of the structure, can be used to temporarily secure the shackle assembly when not being utilized.

In use, the shackle assembly may be either raised or lowered from a resting position within the recess to a towing position so that a towing line can be secured to the assembly. If a retaining device is employed, then the device must be released prior to raising or lowering the shackle assembly. The structure can then be towed to a desired location.

An advantage of the present invention is that the apparatus can be retracted into the outer wall of an offshore structure when the apparatus is not in use thereby protecting it from damage caused by ice.

The various features of novelty which characterize the invention are pointed out with particularity in the claims forming a part of this disclosure. For a better understanding of the invention, its operating advantages and specific objects obtained by its uses, reference should be made to the accompanying drawings and descriptive matter in which there are illustrated preferred embodiments of the invention.

DESCRIPTION OF THE PREFERRED EMBODIMENT

Figure 1:
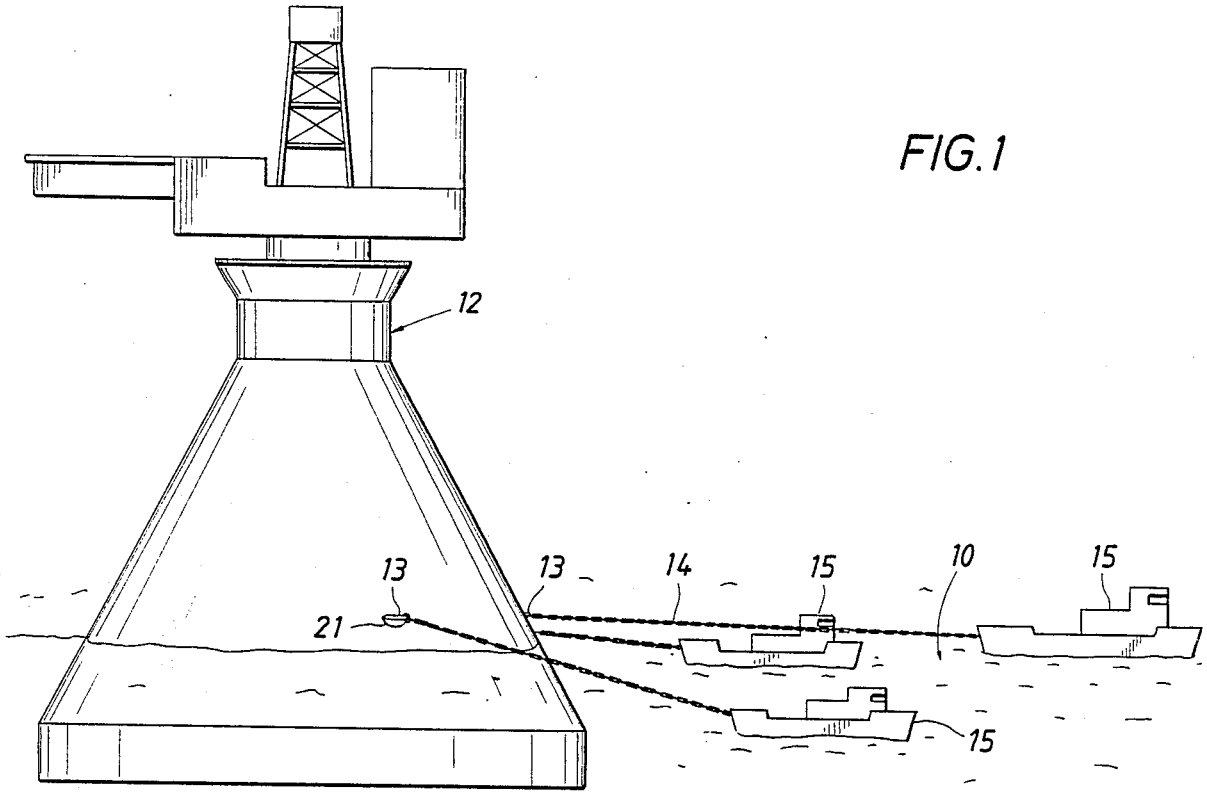
FIG. 1 is a diagrammatic view of the apparatus for use in the offshore structure.

Referring to FIG. 1 of the drawing, an offshore structure represented herein by numeral 12 designed for exploration and/or production, such as one located in ice-infested waters 10, has a portion above the deepest water line of the ice-infested waters, say 150 feet, and a lower portion below the water line. The structure pictorially shown in FIG. 1 typically weighs approximately 110,000 tons and has a base diameter of 394 feet. The upwardly converging walls of the structure cause the ice sheets impinging on the walls to fail in flexure by placing a tensile stress in the ice.

Conventional towing devices mounted on the outer walls of the structure well known in the art, such as pad eyes, could be damaged by the significant forces caused by ice sheets impinging on the outer walls of the structure.

The apparatus of the present invention includes at least two, but preferably up to six, shackle assemblies 13. Each assembly 13 is located in a recess 21 formed in the outer wall of the structure. A tow line 14, such as a towing chain or cable, is secured to the shackle assembly 13 for towing by a vessel, such as a tug boar 15.

Figure 2:
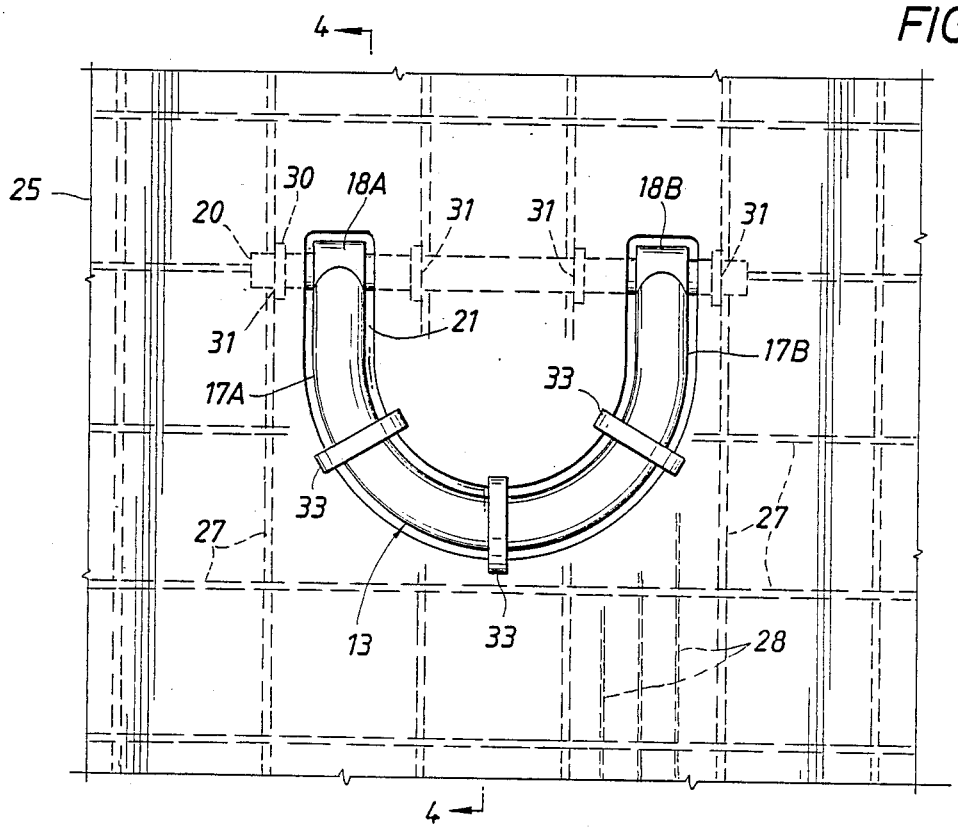
FIG. 2 is a plan view of the apparatus retracted into the outer wall of an offshore structure.
Figure 3:
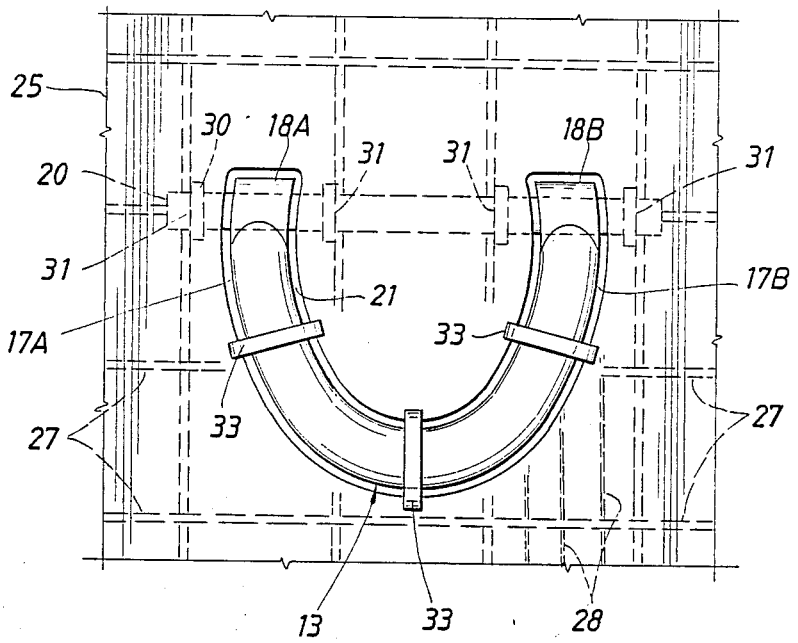
FIG. 3 is a plan view of another preferred embodiment of the apparatus.

The shackle assembly 13 shown in FIG. 2 has legs 17A, 17B spaced apart terminating in eyes 18A, 18B adapted to receive a shackle pin 20 therethrough. The shackle assembly 13 can be substantially U-shaped, partially circular-shaped (FIG. 3), or configured in any other shape for towing which is well known to the art. The distance between the outer walls of legs 17A and 17B where the shackle pin 20 is inserted through the eyes 18A, 18B is approximately eight feet in a preferred embodiment.

A recess 21 (FIG. 2) is formed in the outer wall 25 of the structure to allow the shackle 13 to retract into the wall 25 when the shackle is not in use.

A mounting device, such as a doubler 30 or bracket, is fixedly secured within the wall 25 and has an aperture 31 for receiving a shackle pin 20 therethrough. The doubler 30 may be secured in the wall 25 at the upper or lower (not shown) portion of the recess 21. Securing the doubler 30 in the wall 25 at the upper portion of the recess 21 as shown in FIG. 2 is preferred because the shackle can be raised to the desired towing position as shown in the phantom position in FIG. 4. The doubler 30 (FIG. 2) serves to transfer the pulling force caused by the towing operation to the load bearing outer wall 25 of the structure 12. The wall 25 can be reinforced using webs 27 and stiffeners 28 or in any other manner well known to the art.

A retaining device, such as a dog 33, secures the shackle within the recess 21 when the shackle 13 is not in use. The dogs 33 shown in FIG. 2 may be mounted on the outer wall 25 of the structure 12 or may be insertable.

Figure 4:
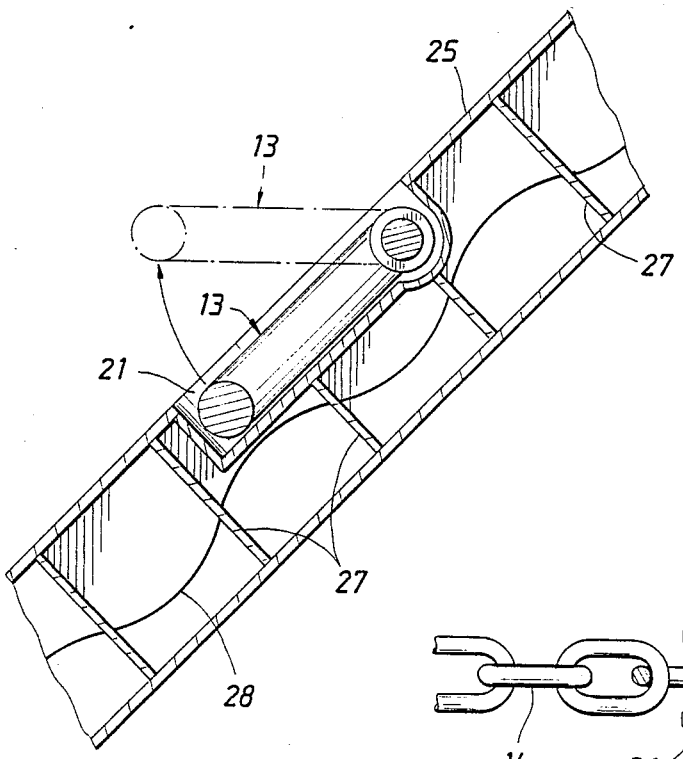
FIG. 4 is a cross-sectional view taken along the line 4—4 of FIG. 2 of the apparatus in retracted and non-retracted positions with the respect to the outer wall of the offshore structure.
Figure 5:
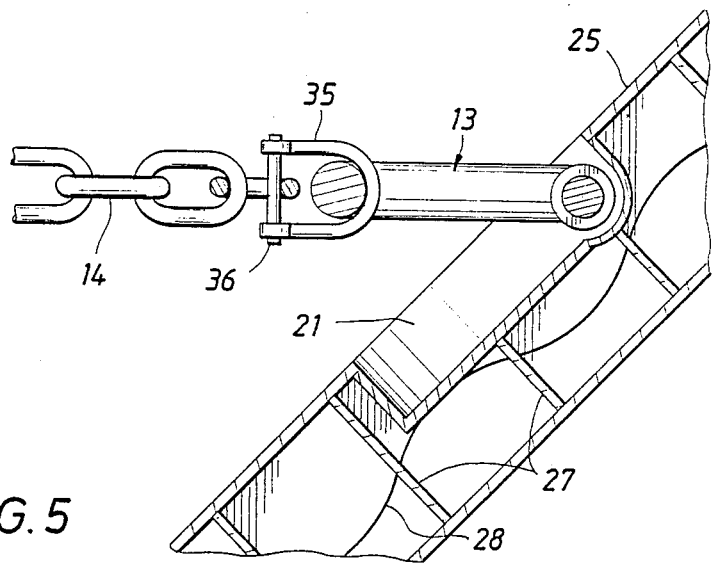
FIG. 5 is a cross-sectional view taken along the line 4—4 of FIG. 2 illustrating the towing arrangement of the apparatus.

In operation, a tow line 14, such as a towing chain or bridle, is secured to the shackle 13 using a clevis 35 and pin 36 arrangement shown in FIG. 5 or in any other manner well known to the art. The shackle 13 is raised or lowered (not shown) from a resting position within the recess 21 to a desired towing position (FIG. 4). If dogs 33 (FIG. 2) are used to maintain the shackle 13 in a retracted position, then they must be released prior to raising the shackle 13. The structure 12 can then be towed to a desired location.

Thus, it can be seen that the above-mentioned objective may be accomplished, based on the description of the preferred embodiment, by practicing the above-mentioned invention.

What is claimed is:

1. An apparatus for towing an offshore structure comprising:

a shackle having spaced apart legs terminating in eyes adapted to receive a shackle pin therethrough;

means for avoiding impingement of ice on said shackle, said means including a recess in an outer wall of said structure for receiving said shackle; and mounting means fixedly secured within said wall having an aperture for receiving said shackle pin therethrough.

2. The apparatus of claim 1 wherein said apparatus includes retaining means operatively carried by said outer wall of said structure for securing said shackle within said recess.

3. The apparatus of claim 1 or 2 wherein said shackle is substantially U-shaped.

4. The apparatus of claim 1 or 2 wherein said shackle is partially circular-shaped.

5. A method of towing an offshore structure comprising:

avoiding impingement of ice on a retractable shackle assembly by positioning said retractable shackle assembly within a recess in an outer wall of said structure;

extending said shackle assembly from said recess to a towing position;

securing towing means to said shackle assembly; and towing said structure with said towing means.

6. A method of towing an offshore structure comprising:

avoiding impingement of ice on a retractable shackle assembly by positioning said retractable shackle assembly within a recess in an outer wall of said structure;

securing towing means to said shackle assembly;

extending said shackle assembly from said recess to a towing position; and towing said structure with said towning means.

7. The method of claims 5 or 6 including the step of:

releasing retaining means operatively carried by said outer wall of said structure for securing said shackle within said wall

* * * * *